US005834667A

United States Patent [19]

Midkiff

[11] Patent Number: 5,834,667

[45] Date of Patent: Nov. 10, 1998

[54] MULTI-LEVEL DRUM RIM DESIGN

[76] Inventor: Walter M. D. Midkiff, 18803 Cryer Dr., Banning, Calif. 92220

[21] Appl. No.: 850,661

[22] Filed: May 2, 1997

[51] Int. Cl.[6] ..... G10D 13/02

[52] U.S. Cl. ..... 84/411 R; 84/415

[58] Field of Search ..... 84/411 R, 411 A, 84/415, 418

[56] References Cited

U.S. PATENT DOCUMENTS 4,283,985 8/1981 Famularo ..... 84/411 R
4,344,349 8/1982 Cordes ..... 84/411

*Primary Examiner*—Michael L. Gellner
*Assistant Examiner*—Shih-yung Hsieh
*Attorney, Agent, or Firm*—David Pressman

[57] ABSTRACT

A drum rim design for providing an increased variety of sounds while reducing a drummer's physical exertion comprises a rim on which three or more portions (12), (13), and (14) of the uppermost periphery of the upright section of the rim have respectively different heights. A user of the drum can rotate the drum to place the rim portion having the desired height adjacent the user. When the user wishes to play the drum in a conventional manner, the user can rotate the drum so that the portion of the rim having a relatively larger height is adjacent the user. This will provide rather conventional rim shot performance. When the user wishes a predictably different rim shot sound, or wishes to play rim shots at a reduced angle of performance, with the ergonomic benefit of placing correspondingly less strain on the shoulder and elbow, the user may then rotate the drum so that a portion of the rim having an uppermost rim of reduced height is adjacent the user. Or, for an intermediate sound, the user can rotate the drum so that a portion of the rim having a height in between the shortest and tallest rim heights is adjacent the user. This provides the user with considerably greater control and a greater variety of sounds, from higher and sharper to lower and deeper, to choose from during rim shot play.

14 Claims, 2 Drawing Sheets

MULTI-LEVEL DRUM RIM DESIGN

BACKGROUND

1. Field of Invention

This invention relates to drums, specifically to drums with an improved rim design.

2. Prior Art

Drummers are often called upon to perform a specific type of stroke called a "rim shot." It is achieved by causing the drumstick to intentionally contact both the drum rim and the drum head, or skin, simultaneously. Drum rims of the conventional type have a rather high rim height. This allows a limited amount of stick tip contact during a rim shot, due to the rather high angle of performance required. This elevated angle is necessitated by the rather high rim height relative to the playing surface of the drumhead. The higher angle of performance necessary to make this stroke correctly places considerable strain on the player's elbow and shoulder. It is common among drummers exposed to these strains to develop repetitive motion syndrome, resulting in various injuries, such as tennis elbow, tendonitis, etc. Means of reducing this strain, plus giving the user more control over the rim-shot technique, have been sought by drummers ever since rim shots became a regular part of drumming technique.

One method used to modify the sound of rim shots is shown in U.S. Pat. No. 4,344,349 to Cordes (1982), where an arcuate section of plastic material is attached to the inside surface of a metal drum rim and protrudes above the rim to provide a softer uppermost rim contact surface for the drumsticks to play against. This softer, more rounded surface, when struck, of course provides a considerably different sound than is typically produced by the usual metal uppermost rim surface during a rim shot. The sound of hitting a plastic rim is so different, in fact, from that of hitting a metal rim, that there is some question as to whether this stroke (against the plastic) should still be called a rim shot. Certainly the arcuate plastic section, protruding as it does even further above a standard metal rim, does nothing, ergonomically, for the drummer's angle of performance. In fact, the raised contact surface forces the drummer, wishing to strike the drum head and the rim simultaneously, into an even steeper performance angle.

A method used to provide a drummer with a more horizontal performance angle is shown in U.S. Pat. No. 4,283,985 to Famularo (1981), where a portion of the periphery of the upright section of a rim is either omitted or substantially reduced. This simple modification to a standard rim could essentially be performed in a few minutes with a hand-held grinder by a frustrated musician, and may have been thus invented, initially. While this may indeed represent an ergonomic improvement, it certainly was not done with an eye to improving rim-shot performance. Neither rim shots nor rim shot-technique, in fact, are mentioned in this patent.

In conclusion, neither of these two patented devices provides a drummer with both ergonomic improvements and enhanced rim shot performance.

OBJECTS OF THE INVENTION

It is an object of the invention to provide an improved drum. Another object is to provide drum rims that make the performance of the stroke called a "rim shot" more consistently performable with greater physical ease. It is a further object to provide drum rims that provide the performer with a greater variety of "rim shot" sounds by allowing an increased amount of stick-to-head contact during the percussion stroke. Yet a further object is to provide a more user friendly, yet economical drum.

Still further objects and advantages will become apparent from a study of the following description and the accompanying drawings.

DRAWING FIGURES

SUMMARY

In accordance with the present invention, an improved drum rim comprises vertical edges which are progressively reduced in stages around their periphery. This reduction is limited only by the need to protect the edge of the inner frame of the drum (bearing edge).

DESCRIPTION—FIGS. 1, 2, AND 3

Figure 1:
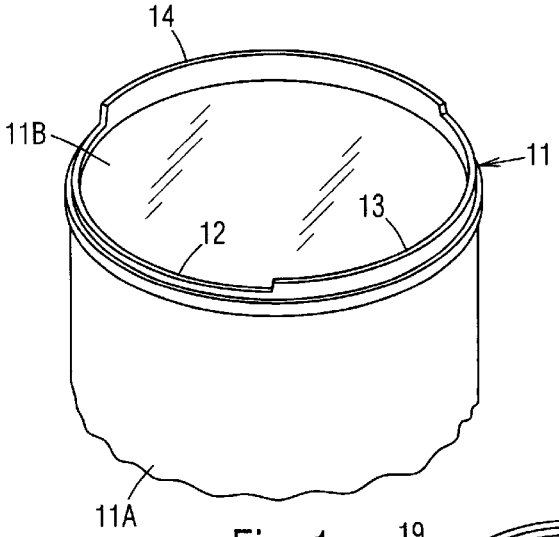
FIG. 1 is a side view of a drum rim in accordance with the invention, wherein the uppermost rim surface is divided into three levels—6 mm, 12 mm, and 18 mm.
Figure 2A:
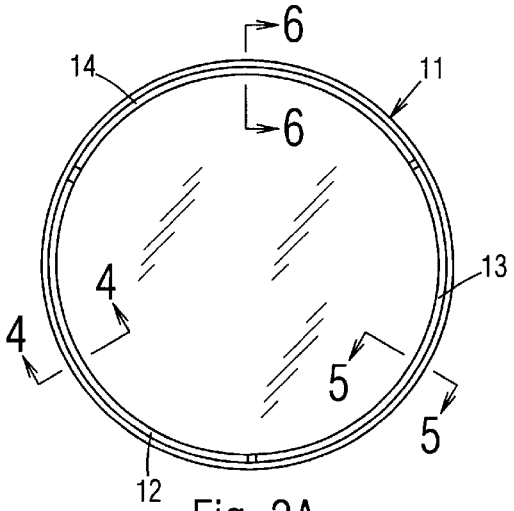
FIG. 2A is a top view of the drum rim of FIG. 1.
Figure 2B:
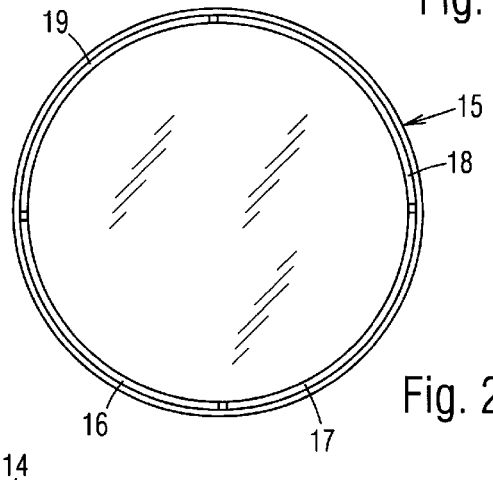
FIG. 2B is a top view of a drum in accordance with the invention, wherein the uppermost rim surface is divided into four levels.
Figure 3:
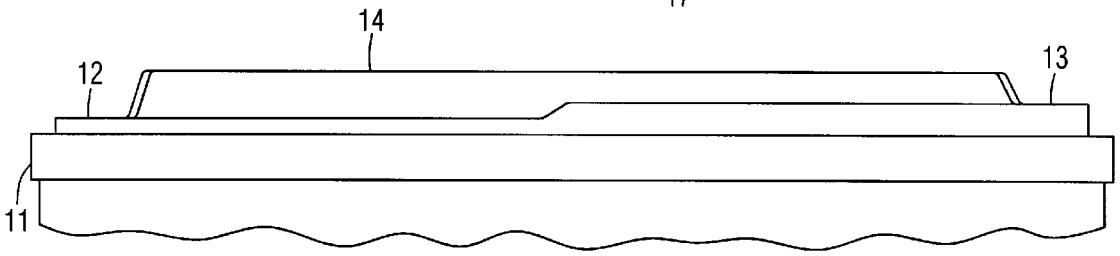
FIG. 3 is a side view of the drum rim of FIG. 1.

FIGS. 1, 2, and 3 show a preferred embodiment of a drum rim 10 according to applicant's invention. Rim 10 has a conventional Vti hoop 11 at its bottom which includes holes for securing the rim to the drum shell 11A using conventional hardware such as tuning rods (not shown). The rim secures a skin or drum head 11B, in the conventional manner. The rods are reduced in height to accommodate the 6 mm rim height 12 as described below. The height of hoop 11 is not critical—9 mm and 10 mm being typical. The top of the rim extends up at three heights—6 mm at height 12, 12 mm at height 13, and 18 mm at height 14. The rim heights are exaggerated in FIG. 1 for ease of illustration. These heights are presently preferred and not the only usable heights. No critical head tension is necessary beyond a reasonable tightness suitable for producing a drum sound.

DESCRIPTION—FIGS. 4, 5, AND 6

Figure 4:
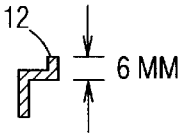
FIG. 4 is a side elevational cross-section for a 6 mm portion of the rim of FIG. 2A.
Figure 5:
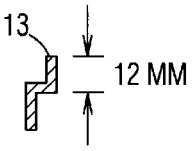
FIG. 5 is a side elevational cross-section for a 12 mm portion of the rim of FIG. 2A.
Figure 6:
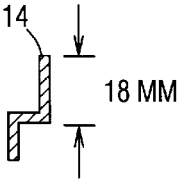
FIG. 6 is a side elevational cross-section for an 18 mm portion of the rim of FIG. 2A.

FIGS. 4, 5, and 6 show cross-sections of rims with, respectively, uppermost rim heights of 6 mm, 12 mm, and 18 mm. While these cross sections have a step shape (a lower vertical portion, a horizontal step, and a vertical upper portion of the indicated height), the inventive rim design may employ alternative rim edges, including flat, flanged inward, flanged outward, or with any other angular termination.

DESCRIPTION—FIG. 2B

FIG. 2B shows a top view of an alternative four-height rim. The rim heights 16, 17, 18, and 19 are divided equally into fourths around the circumference of the rim 15. For example, a rim with a circumference of 114 cm and a 35.5 cm diameter head provides four rim height areas, each having a circumferential length of 28.5 cm. Dividing the circumference into five or more parts is also possible, although the ideal embodiment—comprised of a 35.5 cm head divided into three parts—provides sufficient area for a drummer to rotate the drum to place a particular rim height in ideal playing position for playing with two drumsticks, one in each hand. The three rim heights also provide optional rim shot areas between which drummers may alternate for an increased variety of sounds, as will be discussed below.

DESCRIPTION—FIGS.7, 7A, 8, 8A, 9, AND 9A

Figure 7:
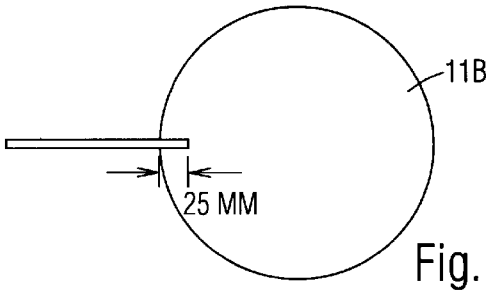
FIG. 7 is a top view of a stick hitting the inventive drum head 25 mm from the 6 mm rim.
Figure 7A:
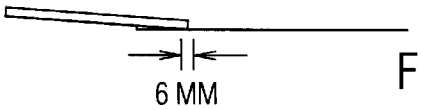
FIG. 7A is a side view of FIG. 7 showing the stick angle, point of contact, and extent of head contact.
Figure 8:
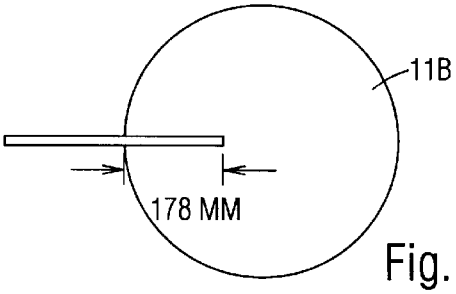
FIG. 8 is a top view of a stick hitting the inventive drum head 178 mm from the 6 mm rim.
Figure 8A:
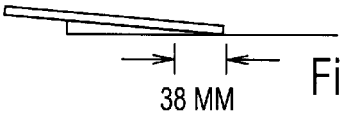
FIG. 8A is a side view of FIG. 8 showing the stick angle, point of contact, and extent of head contact.
Figure 9:
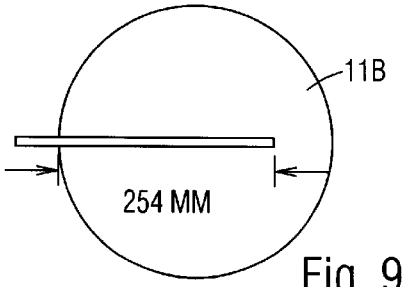
FIG. 9 is a top view of a stick hitting the inventive drum head 254 mm from the 6 mm rim.
Figure 9A:
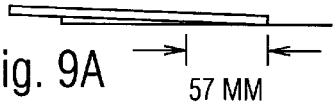
FIG. 9A is a side view of FIG. 9 showing the stick angle, point of contact, and extent of head contact.

FIGS. 7, 8, and 9 show top views of a drum head with an uppermost rim height of 6 mm as a drumstick is used to hit the head at 25 mm, 178 mm, and 254 mm, respectively, in from the 6 mm rim. FIGS. 7A, 8A, and 9A are, respectively, side views of FIGS.7, 8, and 9, showing the stick angles, points of contact, and the amounts of head contact resulting when a 6 mm rim height is used for rim shots.

It is important to note that the different stick angles, points of contact, and amounts of stick-to-head contact necessarily resulting from playing rimshots when rims of differing heights are adjacent the user do produce very different-sounding rim shots. Basically, flatter stick angles, points of contact closer to the center of the drum, and more stick-to-head contact all tend to produce deeper, lower-octave sounds that are also easier to play, while higher stick angles, points of contact closer to the rim, and less stick-to-head contact tend to produce more shallow, higher-pitched sounds that are more difficult to produce accurately and that place more strain on the player.

DESCRIPTION—FIGS. 10, 10A, 11, 11A, 12, AND 12A

Figure 10:
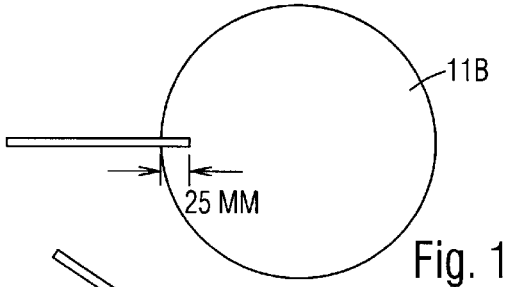
FIG. 10 is a top view of a stick hitting the inventive drum head 25 mm from the 18 mm rim.
Figure 10A:
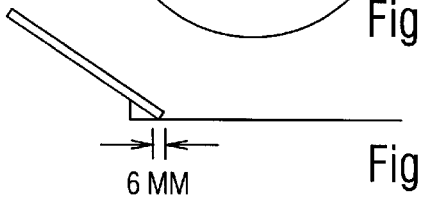
FIG. 10A is a side view of FIG. 10, showing the stick angle, point of contact, and extent of head contact.
Figure 11:
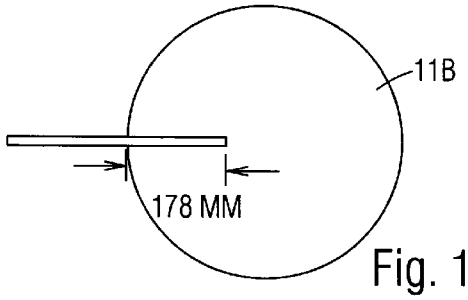
FIG. 11 is a top view of a stick hitting the inventive drum head 178 mm from the 18 mm rim.
Figure 11A:
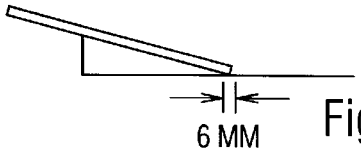
FIG. 11A is a side view of FIG. 11 showing the stick angle, point of contact, and extent of head contact.
Figure 12:
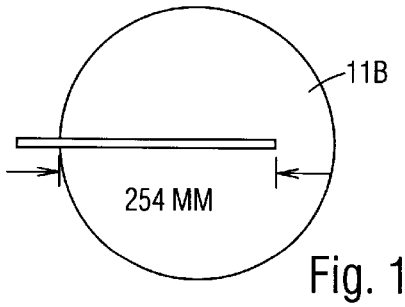
FIG. 12 is a top view of a stick hitting the inventive drum head 254 mm from the 18 mm rim.
Figure 12A:
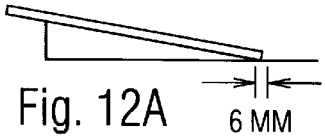
FIG. 12A is a side view of FIG. 12 showing the stick angle, point of contact, and extent of head contact.

FIGS. 10, 11, and 12 show top views of a drum head with an uppermost rim height of 18 mm as a drumstick is used to hit the head at 25 mm, 178 mm, and 254 mm, respectively, from the 18 mm rim. Note the steeper stick angles and the reduced amount of head contact resulting for the same points of contact when the 18 mm rim is used. FIGS. 10A, 11A, and 12A, respectively, show the stick angles, points of contact, and extents of head contact resulting as the 18 mm rim height is used in FIGS. 10, 11, and 12. Heights of 6 mm and 18 mm are used for example only. Heights lower than 6 mm, however, may damage the drum's bearing edge under the head and cause premature head damage or wear.

It is immediately evident from comparing FIGS. 7A, 8A, and 9A, respectively, with FIGS. 10A, 11A, and 12A, that a lowered rim height provides greater ease of playing due to the lower angles of play possible and to the increased extents of head contact provided. The likelihood of achieving accurate rim shots is greatly improved, providing greater play consistency. The ergonomic benefits of the reduced angles of play also become evident. The greater ease of hitting a lower rim reduces the need for precision on the part of the drummer in hitting rim shots and decreases the likelihood of mis-strokes, thereby making rim shots more consistently performable with greater physical ease.

The intermediate rim height 13 shown in FIGS. 1, 2, and 3 provides features similar to those of the low rim height 12, also K shown in FIGS. 1, 2, and 3. While the higher rim height of the intermediate rim 13 makes it somewhat more difficult to strike the rim and drum head simultaneously, and while the stick-to-head contact area is reduced, the rim of intermediate height does provide additional harmonic and percussive sounds not possible with a conventional rim.

CONCLUSION, RAMIFICATIONS, AND SCOPE

The reader will see that, according to the invention, I have provided an improved drum that can be produced economically, with greater versatility and ergonomic benefits, especially for rim shots. A greater variety of rim shots can be made more consistently, with increased stick-to-head contact, with less strain on the player and with less margin for error.

While the above description contains many specificities, these should not be construed as limitations on the scope of the invention, but as exemplifications of the presently preferred embodiments thereof. Many other ramifications and variations are possible within the teachings of the invention. For example, the material, shape, and dimensions of the rim can be changed, as can the number of heights. The width of the rim and the texture of its uppermost surface can be changed to produce different sounds. The rim can be made in six sections with four levels as follows: for a 36 cm diameter (112 cm circumference) drum, the rim would have a 35 cm long/6 cm tall low section, sandwiched between two 22 cm long/12 mm tall medium-low sections, in turn sandwiched between two 4 cm long/15 mm tall medium-high sections, which also sandwich a final 25 cm long/18 mm tall section. This drum can be used to K produce four different rim-shot sounds and will accommodate both left-handed and right-handed drummers.

Thus the scope of the invention should be determined by the appended claims and their legal equivalents, and not by the examples given.

I claim:

1. In a drum having a drumhead, a rim extending up from an upper side of said drumhead around a periphery of said drumhead, said rim comprising at least three sections having respectively different heights, maximum, minimum, and intermediate, whereby a user of said drum can rotate said drum so that a section of said rim having said maximum height can be rotated to a position adjacent said user when said user wants to play said drum in a conventional rim-shot manner by striking said maximum height section and said drumhead simultaneously, so as to produce the relatively shallow higher-pitched sound of a conventional rim shot, a section of said rim having said minimum height can be rotated to a position adjacent said user when said user wants to play said drum in a rim-shot manner that will produce a relatively lower-pitched, deeper sound when said minimum height section and said drumhead are struck simultaneously, and a section of said rim having said intermediate height section can be rotated to a position adjacent said user when said user wants to play said drum in a rim-shot manner that will produce an intermediately-pitched sound of intermediate depth when said intermediate height section and said drumhead are struck simultaneously.

2. The drum of claim 1 wherein said rim has at least four sections having respectively different heights so that said user can produce at least four different rim-shot sounds.

3. The drum of claim 1 wherein said rim is made of metal.

4. The drum of claim 1 wherein said sections of said rim are substantially equal in circumferential length.

5. The drum of claim 1 wherein said different heights of said rim are between 5 and 20 millimeters.

6. The drum of claim 1 wherein said sections of said rim are connected by sloping transitional portions.

7. The drum of claim 1 wherein said minimum height section of said rim extends up about 6 millimeters from said drumhead.

8. A drum comprising:

a cylindrical body having a wall which is parallel to and concentric to an axis, drumhead at one end of said cylindrical body, said drumhead being perpendicular to said axis and having a periphery, and a rim extending up from said periphery of said drumhead, an improvement wherein said rim has at least three different heights extending up from said periphery of said drumhead, whereby a user of said drum may strike said rim and said drumhead simultaneously with drumsticks in a plurality of different ways using a plurality of different drumstick angles to produce a plurality of different sounds.

9. The drum of claim 8 wherein said rim has at least four sections having respectively different heights so that said user can produce at least four different rim-shot sounds.

10. The drum of claim 8 wherein said rim is made of metal.

11. The drum of claim 8 wherein said sections of said rim are substantially equal in circumferential length.

12. The drum of claim 8 wherein said different heights of said rim are between 5 and 20 millimeters.

13. The drumhead of claim 8 wherein said sections of said rim are connected by sloping transitional portions.

14. The drum of claim 8 wherein said minimum height section of said rim extends about 6millimeters above said drumhead.

* * * * *

UNITED STATES PATENT AND TRADEMARK OFFICE

CERTIFICATE OF CORRECTION

PATENT NO. : 5, 834,667

DATED : Nov 10, 1998

INVENTOR(S) : Walter M. D. Midkiff

It is certified that error appears in the above-identified patent and that said Letters Patent is hereby corrected as shown below:

Col. 2, line 64, delete "Vti".

Col. 4, line 52, delete "K".

Col. 6, line 1, before drumhead" insert —a—.

Signed and Sealed this

Eleventh Day of May, 1999

*Attest:*

*Attesting Officer*

Q. TODD DICKINSON

*Acting Commissioner of Patents and Trademarks*